US006336344B1

(12) United States Patent
O'Brien

(10) Patent No.: US 6,336,344 B1
(45) Date of Patent: Jan. 8, 2002

(54) DEPHLEGMATOR PROCESS WITH LIQUID ADDITIVE

(75) Inventor: John V. O'Brien, Shrewsbury, MA (US)

(73) Assignee: Chart, Inc., Mayfield Hts., OH (US)

( * ) Notice: Subject to any disclaimer, the term of this patent is extended or adjusted under 35 U.S.C. 154(b) by 0 days.

(21) Appl. No.: 09/579,953

(22) Filed: May 26, 2000

Related U.S. Application Data

(60) Provisional application No. 60/135,969, filed on May 26, 1999.

(51) Int. Cl.[7] ..... F25J 3/00
(52) U.S. Cl. ..... 62/627; 62/928
(58) Field of Search ..... 62/620, 627, 920, 62/928, 929

(56) References Cited

U.S. PATENT DOCUMENTS 4,293,322 A 10/1981 Ryan et al.
4,318,723 A * 3/1982 Holmes et al. ..... 62/620
4,350,511 A * 9/1982 Holmes et al. ..... 62/620
4,451,274 A * 5/1984 O'Brien ..... 62/620
4,462,814 A 7/1984 Holmes et al.
RE32,600 E 2/1988 Ryan et al.
5,011,521 A 4/1991 Gottier
5,017,204 A 5/1991 Gottier et al.
5,035,732 A * 7/1991 McCue ..... 62/627
5,634,354 A * 6/1997 Howard et al. ..... 62/624
5,802,871 A 9/1998 Howard et al. .....

* cited by examiner

*Primary Examiner*—William C. Doerrler
(74) *Attorney, Agent, or Firm*—Calfee, Halter & Griswold, LLP

(57) ABSTRACT

A cryogenic process for the separation of one light gas component from a heavier gas component in a gas feed stream, by injecting a liquid hydrocarbon additive stream into the top or upper portion of a dephlegmator-heat exchanger, to increase the rectification temperature, or to maintain the temperature and reduce the additive flow rate relative to the respective values required with a conventional, single stage condenser.

25 Claims, 3 Drawing Sheets

DEPHLEGMATOR PROCESS WITH LIQUID ADDITIVE

REFERENCE TO PRIOR APPLICATIONS

This application incorporates by reference and claims the benefit of the filing date of U.S. Provisional Patent Application Ser. No. 60/135,969, filed May 26, 1999.

BACKGROUND OF THE INVENTION

A process known in the field as the Ryan-Holmes process employs the use of bottoms additives, such as a $C_4$+ stream into the upper portion of a distillation column or the reflux condenser of the column, to enhance distillation separation and to save energy. The Ryan-Holmes process and modifications are described in part in U.S. Pat. Nos. 4,293,322, issued Oct. 6, 1981; 4,318,723, issued Mar. 9, 1982; 4,350,511, issued Sep. 21, 1982; 4,428,759, issued Jan. 31, 1984, now Reissue Pat. No. 32,600, reissued Feb. 16, 1988; 4,451,274, issued May 29, 1984; 4,462,814, issued Jul. 31, 1984; and 5,345,772, issued Sep. 13, 1994.

The principles of continuous distillation are described in Perry's Chemical Engineer's Handbook, Seventh Edition, McGraw-Hill, Section 13. FIG. 13-1 shows a schematic diagram for a simple distillation column with one feed, a rectifying section above the feed containing multiple stages of vapor/liquid equilibrium, an overhead condenser at the uppermost stage where heat is removed, a stripping section below the feed also containing multiple stages of vapor/liquid equilibrium, and a reboiler at the lowermost stage where heat is added to the system. FIG. 13-3 illustrates a complex distillation process where heat is removed from each stage of the rectifying section and heat is added to each stage of the stripping section.

This process of removing heat from one or more stages of the rectifying section, in addition to the overhead condenser, is known dephlegmation. A dephlegmator is thus a device that enables more than one stage of distillative rectification with the simultaneous removal of heat from each of those stages, without the withdrawal of liquid or vapor streams from the column. It may be used over the whole length of the rectification zone in a distillation column or on a selected zone.

Dephlegmators, which operate as rectifying and heat transfer devices in the gas processing field are well-known, and for example, are employed to separate helium, nitrogen, or helium and nitrogen mixtures from a natural gas stream. Some examples of dephlegmators-heat exchangers used for such separation processes include: U.S. Pat. Nos. 5,011,521, issued Apr. 30, 1991; 5,017,204, issued May 21, 1991; and 5,802,871, issued Sep. 8, 1998.

SUMMARY OF THE INVENTION

The invention relates to a separation and rectification process employing a dephlegmator-heat exchanger device and introducing a liquid additive to improve the rectification process.

The invention comprises a dephlegmator-heat exchanger process for the separation of a light gas component from heavy components in a feed gas stream, which process comprises rectifying the feed gas stream in a dephlegmator-heat exchanger to provide a lean component overhead gas stream and a rich liquid stream. The invention comprises introducing, for example, injecting, during rectifying, a selected amount of a liquid hydrocarbon additive stream, for example, into the top or an upper portion of the dephlegmator-heat exchanger; withdrawing the rich liquid stream with the additive from a lower portion of the dephlegmator-heat exchanger; and withdrawing the lean overhead gas stream from an upper portion of the dephlegmator-heat exchanger. Optionally, the liquid hydrocarbon additive recycled may be recovered from the liquid stream.

It has been discovered that the use of a liquid hydrocarbon additive in a dephlegmator-type heat exchanger in place of a conventional reflux condenser, has two primary benefits: the quantity of liquid hydrocarbon injected is considerably reduced; and for the same liquid hydrocarbon injection flow rate, the condenser temperature is increased. These effects can also be combined at intermediate values of flow and temperature.

The introduction of a liquid additive stream, typically a hydrocarbon stream, such as a $C_4$+ stream, can increase the top or upper operating temperature of the dephlegmator-heat exchanger by at least 10° F., for example, increasing the top temperature to about −30 to −40° F. or more, rather than the usual temperature operating range of about −50 to −150° F., to achieve a given separation of a hydrocarbon feed stream.

In the process, the dephlegmator-heat exchanger device employed may be represented by a heat exchanger whose construction and design, for example, cross-sectional area, permits the device to act as a rectifying distillation column and heat transfer device, wherein vapor flows upwardly, while condensed liquid flows downwardly. The vapor and liquid are in equilibrium in the device, so that several stages of rectification are developed, while each step has heat removed, and in effect, nonadiabatic distillation occurs.

Unlike a process using a condenser where heat is removed from the uppermost rectifying stage only, in the process of this application the dephlegmator is removing heat from more than the uppermost stage of a rectifying zone. The dephlegmator may remove heat from anywhere between two to every stage in the rectifying zone.

The process of the invention may be usefully employed in a variety of processes in the separation of gas feed streams, such as, but not limited to: the separation of acid gases, like carbon dioxide and hydrogen sulfide from methane; the recovery of ethane ($C_2H_6$) and propane ($C_3H_8$) from natural gas streams; the recovery of ethylene ($C_2H_4$) and propylene ($C_3H_6$) from refinery offgas streams; the recovery of ethylene or propylene in ethylene or propylene production plants; and the separation of hydrogen and carbon monoxide by liquid methane.

In many of the processes, the product to be recovered may be from either the overhead (lean) gas stream or the bottoms (rich) liquid stream from the dephlegmator-heat exchanger. The liquid additive may be removed from the bottoms liquid stream and recycled for use in the dephlegmator-heat exchanger, or alternatively, the bottoms liquid stream with the liquid additive may be directed for further processing or use. The illustrative process, as described, employs a single dephlegmator-heat exchanger; however, one or more dephlegmators-heat exchangers of the same or different design may be employed in series or parallel in any process, provided at least one of the dephlegmators-heat exchangers employs a liquid hydrocarbon additive stream. For example, with two dephlegmators-heat exchangers in series, the liquid additives of the same or different hydrocarbon compositions may be injected into one or both dephlegmators-heat exchangers to increase the temperature in each device and to aid the rectification and separation in each dephlegmator-heat exchanger.

The liquid additive introduced into the dephlegmator-heat exchanger may vary in composition and concentration, as required, to increase the dephlegmator-heat exchanger temperature levels and separation efficiency, depending on the particular rectification process carried out. For example, where the process is a carbon monoxide-hydrogen separation, the additive may comprise methane, while with other $C_2$–$C_3$ hydrocarbon separations, the liquid additive may comprise liquid hydrocarbon, or particularly, bottoms recovery products, like $C_4$+ hydrocarbons, i.e., $C_4$–$C_8$, with $C_4$, as the primary component preferred.

Generally, the liquid additive comprises a higher molecular weight hydrocarbon additive stream, which is generated in the particular process, or a by-product of the process, or is separately supplied. Usually, the liquid additive is introduced at the top or directly into an upper section of the dephlegmator-heat exchanger and may be introduced as a separate stream or be sprayed in particulate form into the rising vapor and falling liquid of the dephlegmator-heat exchanger. The amount of the liquid additive may range from about 200 mole percent of the feed gas, such as, from about 5 to 100 mole percent and at temperatures varying from up to 0° F., e.g., −320 to −35° F.

The process will be described for the purpose of illustration only in connection with certain illustrated embodiments; however, it is recognized that various changes, modifications, additions and improvements may be made by those persons skilled in the art of the invention, as described and disclosed, without departing from the spirit and scope of the invention.

DESCRIPTION OF THE EMBODIMENTS

Figure 1:
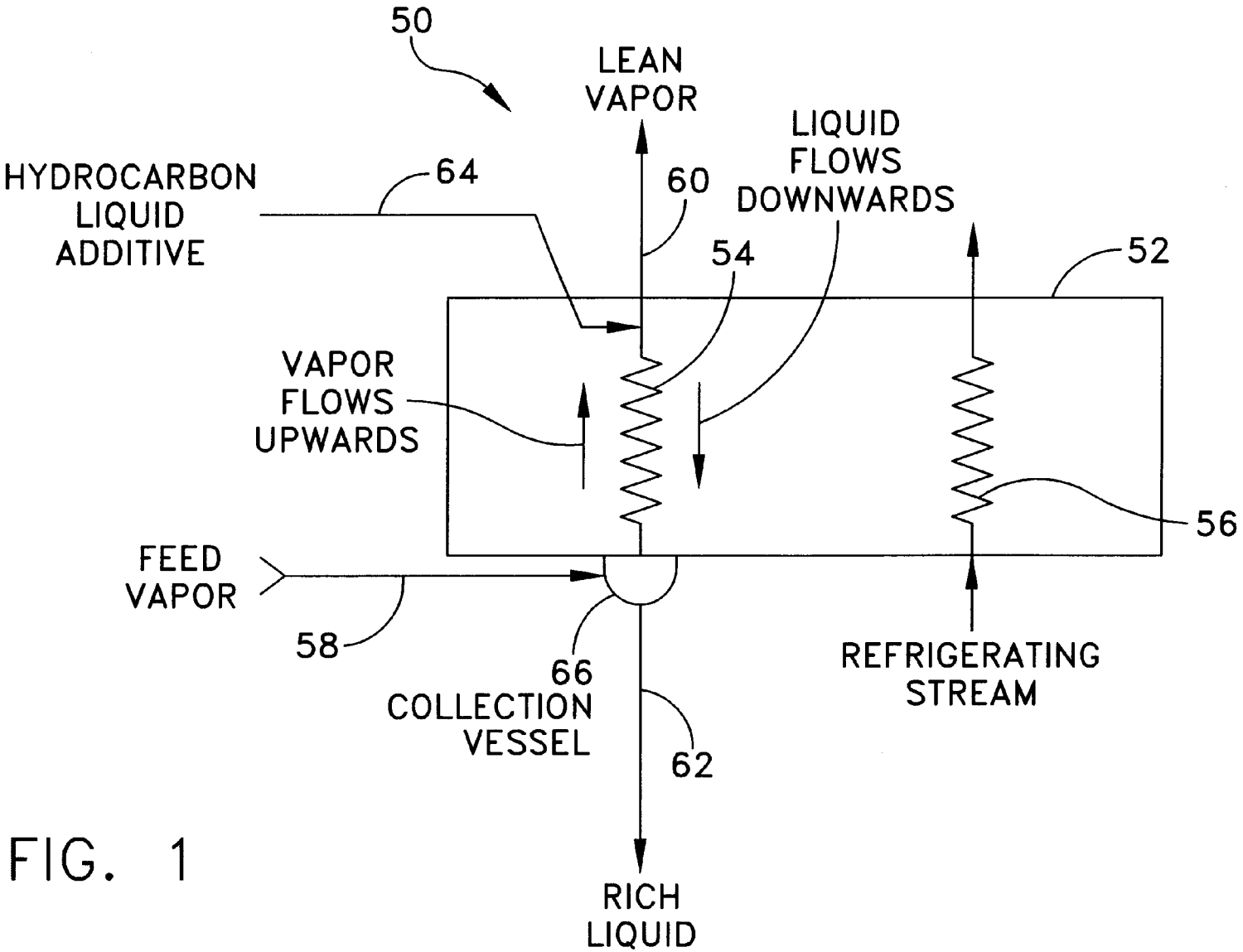
FIG. 1 is a general schematic representation of the use of a dephlegmator-heat exchanger in the process of the invention.

With reference to FIG. 1, there is shown a process 50 employing a brazed aluminum dephlegmator-heat exchanger 52 having a plurality of vertical passages 54 (only one passage is illustrated), with one or a plurality of passages 56 for a refrigerating stream to cool and condense the upward flowing vapors. The dephlegmator-heat exchanger 52 includes an inlet 58 for the lower introduction of an upward flowing feed gas stream an outlet 60 for the upper withdrawal of a gas component lean stream, a lower discharge outlet 62 for the withdrawal of a liquid rich component stream, and a liquid additive injection inlet 64 for the introduction of the liquid additive hydrocarbon stream to the top or upper portion of the dephlegmator-heat exchanger 52. Representative flow arrows are illustrated in the drawing. A collection vessel 66 located at the lower end of the dephlegmator passages permits the distribution of the vapors in the inlet 58 to each passage and also collects the liquid draining from each passage 54 to discharge the combined liquid flow. Both this vessel 66 and the hydrocarbon liquid additive injection inlet 64 avoid reentrainment of the liquid in the vapor stream at each location.

This process can be integrated into a variety of cryogenic distillative or absorption processes. The reason for its effectiveness is that the heat of absorption in the process is absorbed over several theoretical stages of distillation or absorption. Thus, it functions as multiple intermediate condensers, which results in the beneficial effects described above.

The processes can be compared to prior art patents describing the Ryan-Holmes process. Both the prior art processes and the process of the current application may utilize a distillation column with a rectification zone, containing multiple vapor/liquid contact stages. In the prior art process, heat is removed from a single equilibrium condensing stage using a single condenser. In the process of the current invention, utilizing the dephlegmator-heat exchanger 52, heat is able to be removed from two or more (up to every stage of the process) equilibrium stages. The resulting increased efficiency means that in the Ryan-Holmes process the flow rate of the additive hydrocarbon stream (such as $C_4$+) may be reduced while achieving equivalent results compared to the prior art processes. This, in turn, results in reduced system refrigeration and reboiler heat loads.

Figure 2:
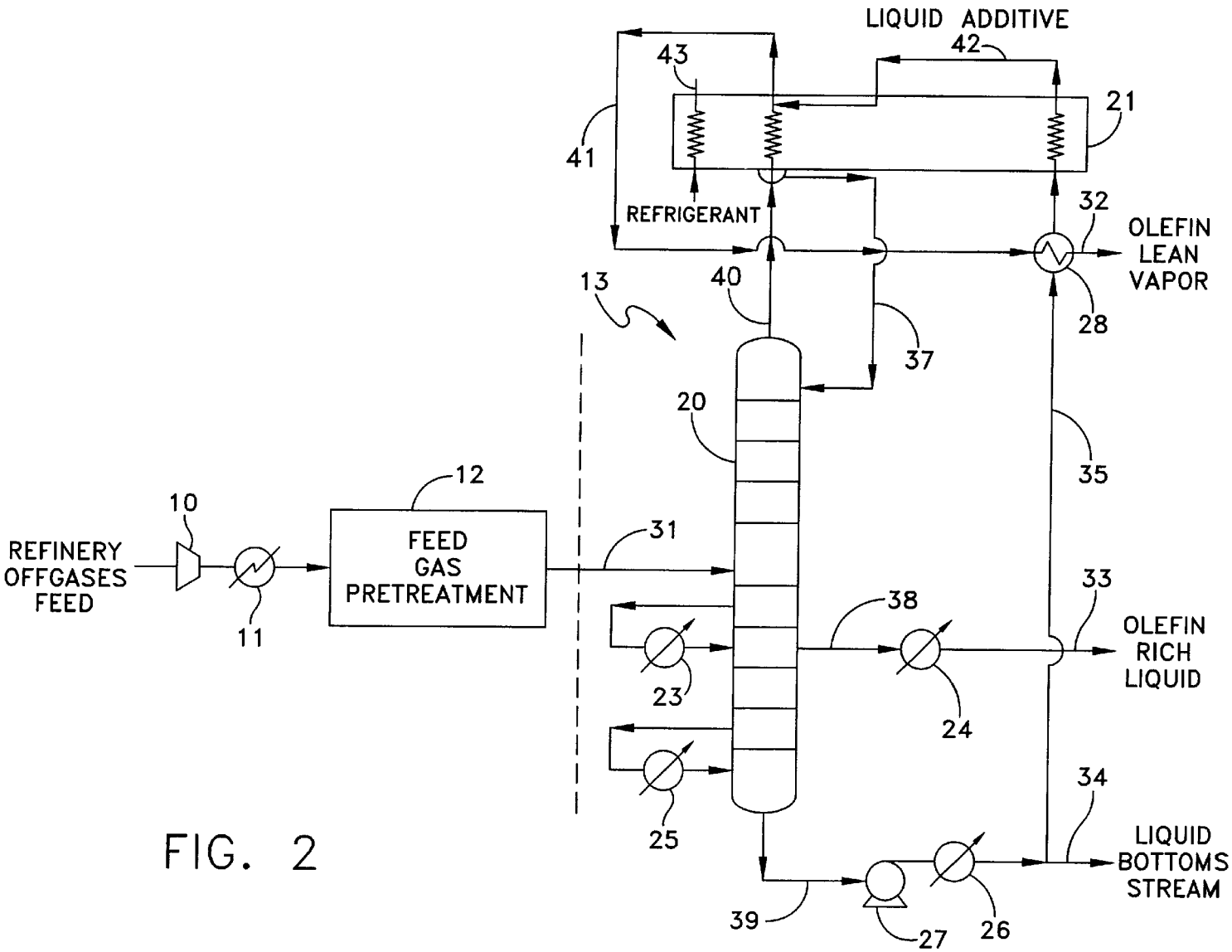
FIG. 2 is a schematic representation of the process of the invention in the recovery of olefins from a Coker or Fuel Catalatic Cracker Unit (FCCU) offgas source.

Some examples of the application of this FIG. 1 process are illustrated in FIGS. 2 and 3.

In FIG. 2, process steps are designated by the 10, 11, 12, and 13 series. Process equipment within step 13 is designated by the 20, 21 . . . series. Process streams within FCCU step 13, are designated by the 31, 32 . . . through 42 series.

The refinery offgases feed considered in this described embodiment are combined FCCU and Coker gases. The gases are at lower pressure, i.e., near atmospheric pressure, and are compressed to about 270 psig in compressor 10, cooled in exchanger 11 to 100° F., and then processed in stages in a pretreatment step 12. These stages may be comprised of a waterwash; an amine contactor column for $H_2S$ removal or other acid gas removal; and a dehydration stage for water vapor removal. The treated gas stream now enters the single column process 13.

The following is a description of the single column process 13 for ethylene recovery, incorporating a dephlegmator-heat exchanger with a liquid hydrocarbon additive. The feed vapor 31 is introduced into column 20. The dephlegmator 21 is mounted overhead the column 20. Vapor 40, from the column 20 (without a reflux condenser), flows directly to the dephlegmator 21. The condensed liquid 37 is returned to the top stage of the column 20. The recycle hydrocarbon stream 35, is chilled in heat exchanger 28 and one passage of dephlegmator 21, and stream 42 is injected into the top of the dephlegmator 21 passages. Propylene refrigerant is used to provide the dephlegmator duty and the recycled liquid hydrocarbon duty in dephlegmator 21. The lean overhead vapor 41 is reheated in heat exchanger 28 and exported as the ethylene lean product stream 32.

The column 20 has a side reboiler 23 for heat conservation purposes. A side vapor draw, stream 38, is extracted from the column 20 at this stage. The side reboiler 23 employs liquid from an intermediate tray of the column 20, below the point of introduction of the feed stream 31, and then after reboiling, returning the reboiled liquid to the tray below the tray from which the liquid is withdrawn. The use of a column intermediate side reboiler 23 enhances the concentration of the olefin component in the vapor side draw stream 38. The vapor side draw stream 38 is withdrawn from between the two intermediate trays used for the side reboiler 23.

The bottom reboiler is 25. The bottoms liquid, stream 39, is pumped by pump 27, then cooled in exchanger 26 and split into two streams 34 and 35. Stream 35 is cooled and recycled to the dephlegmator 21.

The vapor phase side draw, stream 38, is cooled and condensed in exchanger 24, and stream 33 is then withdrawn as the olefin rich liquid stream 33. The split off stream 34 is exported as the heavy liquid bottoms stream 34. The reheated vapor stream 32 may go to the refinery fuel gas stream.

The operating conditions for the column 20, with the dephlegmator-heat exchanger 21, are listed in Table 1. The overall material balance and the recycle stream flow and composition is given in Table 2. For comparison purposes, the conditions for the same process using a conventional condenser are also listed in the same table. For these cases, the recycle liquid flow has been kept constant, while the condenser temperature has been raised from −114° F. (conventional condenser) to −50° F. (dephlegmator-heat exchanger).

TABLE 1

Comparison of Column Conditions
Dephlegmator vs. Conventional Condenser,
Both With Liquid Hydrocarbon Injection
Ethylene Recovery
Column Pressure = 250 PSIG

| HEATER/COOLER | TEMPERATURE (° F.) | DUTY (MMBTU/HR) |
|---|---|---|
| Condenser | −50 (Dephlegmator) | 12.0 |
| and Chiller | −114 (Condenser) | |
| Feed | 17 | |
| Side Reboiler | 155 | 13.9 |
| Reboiler | 337 | 20.1 |

In both instances, the ethylene recovery is 90 percent, while the $C_1/C_2$ ratio is 0.0025 in the product.

In Table 3, the performance features of the process of the invention include: a single fluid refrigeration cycle; a significant reduction in refrigeration compressor power consumption; and elimination of the stainless steel reflux drum and pumping station.

TABLE 3

Comparison of Processes

| REFRIGERATION | CONVENTIONAL CONDENSER | DEPHLEGMATOR |
|---|---|---|
| Cycle Type | Cascade | Single Loop |
| | Ethylene/Propylene | Propylene |
| Compressor Power | 8660 HP | 5400 HP |
| Relative Power | 160 | 100 |

TABLE 2

Single Column Material Balance Ethylene Recovery

| | | Stream ID | | | | |
|---|---|---|---|---|---|---|
| | | 31 | | 33 | 34 | 35 |
| | | Name | | | | |
| | | Feed | Fuel Gas | Light Liquid | Heavy Liquid | Recycle |
| | | Phase | | | | |
| Fluid Rates, lb/mol/hr | | Mixed | Dry Vapor | Mixed | Dry Liquid | Dry Liquid |
| 1 | $H_2O$ | .0000 | .0000 | .0000 | .0000 | .0000 |
| 2 | $H_2S$ | .0295 | 9.5482E−08 | .0295 | 2.4110E−09 | 2.9808E−07 |
| 3 | $N_2$ | 101.0916 | 101.0915 | 7.9409E−07 | .0000 | .0000 |
| 4 | CO | 15.3521 | 15.3520 | 5.1159E−07 | .0000 | .0000 |
| 5 | $CO_2$ | 14.7452 | 8.9584 | 5.7869 | 5.7701E−11 | 7.1338E−09 |
| 6 | $H_2$ | 287.0592 | 287.0588 | 1.3279E−11 | .0000 | .0000 |
| 7 | $C_1$ | 1108.8446 | 1107.0658 | 1.7770 | 6.5158E−15 | 8.0558E−13 |
| 8 | Ethylene | 302.8797 | 30.3389 | 272.5427 | 1.8621E−07 | 2.3022E−05 |
| 9 | $C_2$ | 486.4302 | 8.4172E−04 | 486.4327 | 1.1531E−05 | 1.4257E−03 |
| 10 | Propylene | 254.2555 | .5378 | 253.6669 | .0525 | 6.4968 |
| 11 | $C_3$ | 138.7629 | .7325 | 137.9453 | .0860 | 10.6346 |
| 12 | Isobuten | 18.1834 | .4979 | 17.4023 | .2832 | 35.0071 |
| 13 | 1Butene | 25.3941 | .6988 | 24.2896 | .4056 | 50.1500 |
| 14 | T2Butene | 17.9134 | .4453 | 17.1102 | .3578 | 44.2330 |
| 15 | C2Butene | 12.9536 | .3002 | 12.3737 | .2796 | 34.5641 |
| 16 | 13Butd | .3810 | .0102 | .3645 | 6.3586E−03 | .7861 |
| 17 | $IC_4$ | 31.2459 | .9798 | 29.8409 | .4252 | 52.5700 |
| 18 | $NC_4$ | 23.5549 | .6275 | 22.4764 | .4509 | 55.7502 |
| 19 | $3M_1$Butene | .3733 | 7.1252E−03 | .3528 | .0134 | 1.6516 |
| 20 | 1Pentene | 6.1519 | .0909 | 5.7766 | .2843 | 35.1454 |
| 21 | 2M1Butene | 3.1259 | .0436 | 2.9350 | .1472 | 18.2015 |
| 22 | 2M2Butene | 5.7787 | .0617 | 5.3698 | .3470 | 42.9030 |
| 23 | T2Pentene | 5.0993 | .0620 | 4.7608 | .2764 | 34.1734 |
| 24 | C2Pentene | 2.9111 | .0347 | 2.7166 | .1598 | 19.7527 |
| 25 | $IC_5$ | 17.3760 | .2799 | 16.3346 | .7611 | 94.1029 |
| 26 | $NC_5$ | 8.2941 | .1068 | 7.7517 | .4354 | 53.8301 |
| 27 | 1Hexene | 22.9652 | .1430 | 20.3361 | 2.4847 | 307.1939 |
| 28 | $NC_6$ | 14.8743 | .0752 | 12.9524 | 1.8457 | 228.1893 |
| 29 | $NC_7$ | 5.6047 | 9.9184E−03 | 4.2342 | 1.3599 | 168.1266 |
| 30 | $NC_8$ | 1.1669 | 6.2739E−04 | .6831 | .4830 | 59.7093 |
| 31 | $NC_9$ | .1702 | 2.1248E−05 | .0663 | .1037 | 12.8183 |
| 32 | $NC_{10}$ | .0463 | 1.0473E−06 | .0105 | .0356 | 4.3988 |
| Total Rate, lb − mol/hr | | 2933.0148 | 1551.6116 | 1366.3190 | 11.0842 | 1370.3901 |
| Temperature, ° F. | | 100.0000 | 85.5957 | 100.0000 | 100.0045 | 100.5957 |
| Pressure, psig | | 270.5000 | 246.0000 | 249.5559 | 247.0000 | 280.0000 |
| Enthalpy, mm btu/hr | | 11.5129 | 2.4138 | 6.9835 | .3000 | 3.7577 |
| Molecular Weight | | 26.2661 | 14.8964 | 38.7783 | 79.5827 | 79.5827 |

TABLE 3-continued

| | Comparison of Processes | |
|---|---|---|
| REFRIGERATION | CONVENTIONAL CONDENSER | DEPHLEGMATOR |
| Equipment | Stainless Steel Reflux Drum, Pumps Column Section | No Reflux Drum or Pumps Carbon Steel Column |

In the case where propylene recovery is required from refinery offgas, with the ethylene rejected to the fuel gas, a similar design can be illustrated. In this case, the condenser temperature is kept the same at −35° F. for both options, and the recycled hydrocarbon liquid flow is reduced from 538 to 136 pound moles per hour by the application of the dephlegmator design, i.e., by a factor of four. In both cases, the propylene recovery is maintained at 98 percent and the C2/C3 equals 0.005 in the recovered product.

The invention can also be applied to ethylene recovery from the synthesis gas produced by cracking furnaces for the production of ethylene.

The invention provides benefits in the distillative separation of $CO_2$ and $CH_4$, where a liquid hydrocarbon additive is employed to overcome the potential solids formation, as shown in the following example:

EXAMPLE

With a feed gas containing 24% $CO_2$ and $CH_4$ at −55° F., 525 psig fed to a column having specifications 3% $CO_2$ in the overhead vapor and 2% $CH_4$ in the bottoms stream, and having a $C_5$+ injected to the condenser, the results are listed below:

| | CONVENTIONAL CONDENSER | DEPHLEGMATOR |
|---|---|---|
| Additive rate with overhead at −55° F. lb. moles/hr. | 1159 | 661 |
| Overhead temperature (° F.) additive rate = 661 lb. moles/hr. | −92 | −55 |

Thus, the dephlegmator can be utilized to either reduce the liquid hydrogen injection flow or raise the condenser temperature with the same hydrocarbon injection flow.

The liquid may be injected at many levels over the height of the dephlegmator. This modifies the duty at each theoretical stage and the technique may be used to make more equal refrigeration load at each stage. Also, from a mechanical aspect, it may offer advantages to spread the injection devices over an extended zone of the dephlegmator passages.

Figure 3B:
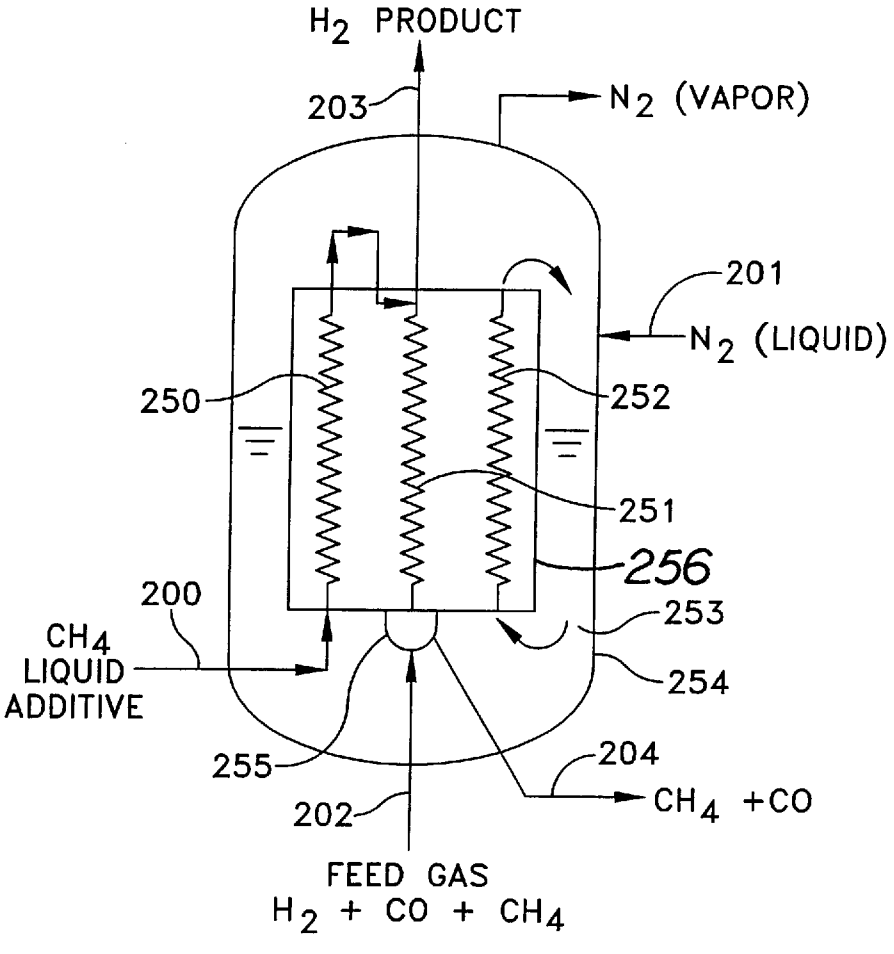
FIG. 3 is a schematic representation of a prior art process (FIG. 3A) and a process of the invention (FIG. 3B) in the separation of hydrogen and carbon monoxide.
Figure 3A:
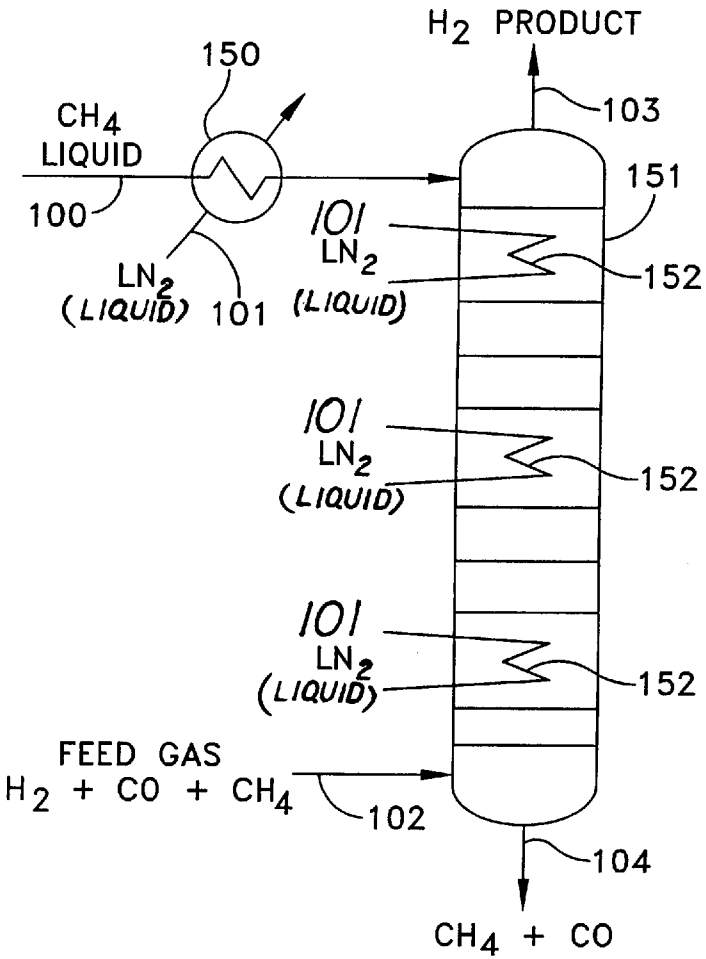
FIG. 3A (PRIOR ART)

FIG. 3 illustrates the application of the invention in a $H_2$/CO separation. The invention may be used for the methane wash process. In the prior art, FIG. 3A, liquid methane stream 100 is subcooled with liquid nitrogen stream 101 in heat exchanger 150 and fed to the top stage of absorption column 151.

The feed gas, stream 102, containing $H_2$, CO and $CH_4$, is fed to below the lowest stage of column 151. The objective of this process is to absorb the gaseous CO in the liquid methane 100. One or more heat exchanger devices 152 are spaced out over the height of the column 151 between the stages, to remove the heat of absorption. Liquid nitrogen 101 is the refrigerating fluid. The hydrogen product, stream 103, is the overhead vapor stream, and the CO absorbed is in the bottoms liquid stream 104.

The improved inventive process is illustrated in FIG. 3B. The dephlegmator 256 is immersed in a pool of liquid nitrogen 253 in vessel 254, which is introduced by stream 201. The liquid nitrogen 253 circulates through passages 252 and is partially vaporized to provide refrigeration. Thus, the whole height of the dephlegmator 256 is at constant temperature. The liquid methane 200 is subcooled in passages 250 and injected to the top of the dephlegmator passages 251. The feed gas 202 enters the separator 255 at the base of these passages. The liquid product 204 is extracted from the separator 255 at this point. The hydrogen product 203 exits at the top. Thus, this device is now a an isothermal cryogenic absorption tower. A prime feature of this invention is that the liquid methane absorption fluid flow rate is minimized, since the temperature excursions over the stages between the cooling devices of the prior art FIG. 3A are eliminated.

Those skilled in the art will recognize this invention is applicable to many cryogenic absorption processes.

What is claimed is:

1. A dephlegmator-heat exchanger process for the cryogenic separation from a feed gas stream of a light gas component and a heavy gas component, which process comprises:

a) rectifying the feed gas stream in a dephlegmator-heat exchanger to provide a lean component overhead gas stream and a rich liquid stream;

b) introducing, during the rectifying step, a selected amount of a liquid hydrocarbon additive into the top or upper portion of the dephlegmator-heat exchanger to maintain the temperature of the dephlegmator-heat exchanger, with a reduced flow rate of the liquid hydrocarbon additive relative to the flow rate required for a conventional, single stage condenser, or to increase the upper temperature of the dephlegmator-heat exchanger for rectification for the same additive flow rate relative to the temperature required for a conventional, single stage condenser, or to obtain selected intermediate values of flow rate and temperature;

c) withdrawing the rich liquid stream from a lower portion of the dephlegmator-heat exchanger; and d) withdrawing the lean overhead gas stream from an upper portion of the dephlegmator-heat exchanger.

2. The process of claim 1 wherein the feed gas stream comprises primarily an acid gas and methane.

3. The process of claim 2 wherein the acid gas comprises carbon dioxide.

4. The process of claim 1 wherein the feed gas stream comprises a gas stream containing $C_2$ and $C_3$ hydrocarbons.

5. The process of claim 4 wherein the $C_2$–$C_3$ hydrocarbons comprise ethane, or propane, or mixtures thereof.

6. The process of claim 4 wherein the $C_2$–$C_3$ hydrocarbons comprise ethylene, or propylene, or mixtures thereof; and the feed gas stream comprises a refinery offgas stream.

7. The process of claim 4 wherein the light $C_2$–$C_3$ hydrocarbons comprise ethylene or propylene to be recovered, and the feed gas stream comprises a gas stream from an ethylene or propylene plant.

8. The process of claim 1 wherein the upper rectification temperature is increased up to about −40° F.

9. The process of claim 1 wherein the additive stream comprises a liquid $C_4$+ stream.

10. The process of claim 1 wherein the one light gas component comprises hydrogen, the feed gas stream comprises hydrogen, methane, and carbon monoxide, and the liquid hydrocarbon additive stream comprises methane.

11. The process of claim 1 wherein the amount of additive stream ranges from about 1 to 200 mole percent of the feed gas stream.

12. The process of claim 1 in which rectifying of the feed gas stream from the top or upper portion of a distillation column occurs solely by the employing of the dephlegmator-heat exchanger.

13. The process of claim 1 which includes increasing the temperature of the dephlegmator-heat exchanger by the liquid additive stream by at least 10° F.

14. The process of claim 1 which includes operating the dephlegmator-heat exchanger as an isothermal absorption tower.

15. The process of claim 1 wherein the feed gas stream comprises a refinery offgas stream, the light gas component comprises an olefin lean vapor, and the heavy gas component comprises an olefin rich liquid.

16. The process of claim 1 which includes separating the liquid hydrocarbon additive from the liquid stream.

17. The process of claim 16 which includes recycling all or part of the recovered liquid hydrocarbon additive to the dephlegmator-heat exchanger.

18. The process of claim 10 which includes introducing the feed gas stream comprising hydrogen; methane; and carbon monoxide into the lower section of the dephlegmator-heat exchanger, cooling the liquid additive methane, and introducing the cooled liquid additive methane into the top or upper portion of the dephlegmator-heat exchanger.

19. The process of claim 6 which includes introducing the feed gas stream from the top or upper portion of a distillation column directly into the dephlegmator-heat exchanger.

20. The process of claim 1 which includes maintaining a rectification temperature and reducing the flow rate of the liquid hydrocarbon additive stream by up to 50 percent, relative to a conventional condenser.

21. The process of claim 1 which includes introducing the liquid hydrocarbon additive stream by injecting or spraying the additive stream into the dephlegmator-heat exchanger.

22. A dephlegmator-heat exchanger process for the cryogenic separation from a feed gas stream of a light gas component and a heavy gas component, which process comprises:

a) rectifying the feed gas stream in a dephlegmator-heat exchanger by passing the feed gas stream through at least two distillation stages in the dephlegmator-heat exchanger and distilling the feed gas stream in each distillation stage thereby transferring heat, the distillation stage providing a lean component overhead gas stream and a rich liquid stream;

b) introducing, during the rectifying step, a selected amount of a liquid hydrocarbon additive into an upper distillation chamber of the dephlegmator-heat exchanger to maintain the temperature of the dephlegmator-heat exchanger, with a reduced flow rate of the liquid hydrocarbon additive relative to the flow rate required for a conventional, single stage condenser, or to increase the upper temperature of the dephlegmator-heat exchanger for rectification for the same additive flow rate relative to the temperature required for a conventional, single stage condenser, or to obtain selected intermediate values of flow rate and temperature;

c) withdrawing the rich liquid stream from a lower portion of the dephlegmator-heat exchanger; and d) withdrawing the lean overhead gas stream from an upper portion of the dephlegmator-heat exchanger.

23. The process of claim 22 in which rectifying of the feed gas stream from a top or upper portion of a distillation column occurs solely employing the dephlegmator-heat exchanger.

24. The process of claim 22 further including the step of operating the dephlegmator-heat exchanger as an isothermal absorption tower.

25. The process of claim 22 which further includes the steps of introducing the feed gas stream, which comprises hydrogen, methane, and carbon monoxide, into the lower portion of the dephlegmator-heat exchanger; cooling the liquid additive, which comprises methane; and introducing the cooled liquid additive into an upper distillation chamber of the dephlegmator-heat exchanger.

* * * * *